US005496198A

United States Patent [19]

King

[11] Patent Number: 5,496,198

[45] Date of Patent: Mar. 5, 1996

[54] TROLLING MOTOR CONTROL APPARATUS

[76] Inventor: Terry King, 546 Johnson King Rd., Swansea, S.C. 29160

[21] Appl. No.: 381,778

[22] Filed: Feb. 1, 1995

Related U.S. Application Data

[63] Continuation-in-part of Ser. No. 164,007, Dec. 8, 1993, abandoned.

[51] Int. Cl.[6] ..... B60L 11/02

[52] U.S. Cl. ..... 440/6; 440/7; 440/87

[58] Field of Search ..... 440/1, 6, 7, 62, 440/84, 85, 87; 114/153, 363

[56] References Cited

U.S. PATENT DOCUMENTS

| | | | |
|---|---|---|---|
| 2,666,407 | 1/1954 | Wilkerson | 114/144 |
| 2,845,891 | 8/1958 | Frey | 114/144 |
| 3,039,420 | 6/1962 | Bevis et al. | 115/18 |
| 3,580,212 | 5/1971 | Fortson | 115/18 |
| 4,022,145 | 5/1977 | Tindal | 114/153 |
| 4,143,436 | 5/1979 | Jones | 9/7 |
| 4,195,588 | 4/1980 | Hudson | 115/18 |
| 4,515,567 | 5/1985 | Wilson | 440/7 |
| 4,610,632 | 9/1986 | Osborne | 440/6 |
| 4,631,034 | 12/1986 | Jenne et al. | 440/7 |
| 4,645,462 | 2/1987 | Fulton | 440/6 |
| 4,891,024 | 1/1990 | Benjamin | 440/28 |
| 5,052,325 | 10/1991 | Rhines | 114/363 |
| 5,207,604 | 5/1993 | McMillin | 440/62 |

*Primary Examiner*—Stephen Avila
*Attorney, Agent, or Firm*—Michael A. Mann

[57] ABSTRACT

A control system for a fishing boat trolling motor comprises a pair of cables running from a first pulley on the motor shaft to a second pulley on a bearing assembly that supports a swivel chair so that rotation of the chair produces rotation of the trolling motor. The cables are arranged so that, regardless of whether the trolling motor is mounted to the front or the back of the boat, the boat will be moved in the direction the chair is rotated and two degrees of motor rotation are produced for each degree of chair rotation. The on/off or forward/off/reverse switch for the motor is also attached to a control panel on the chair and rotatable therewith. The switch is preferably positioned to be operated by movement of the user's leg and biased in the off position. Preferably, a motor polarity reversing switch and speed control are also operated from the control panel with the on/off switch. Alternatively, the rotation of the trolling motor and its activation can be obtained by the foot or hand of the user on a bearing assembly that incorporates a trolling motor on/off or forward/off/reverse switch.

20 Claims, 12 Drawing Sheets

FIG 3
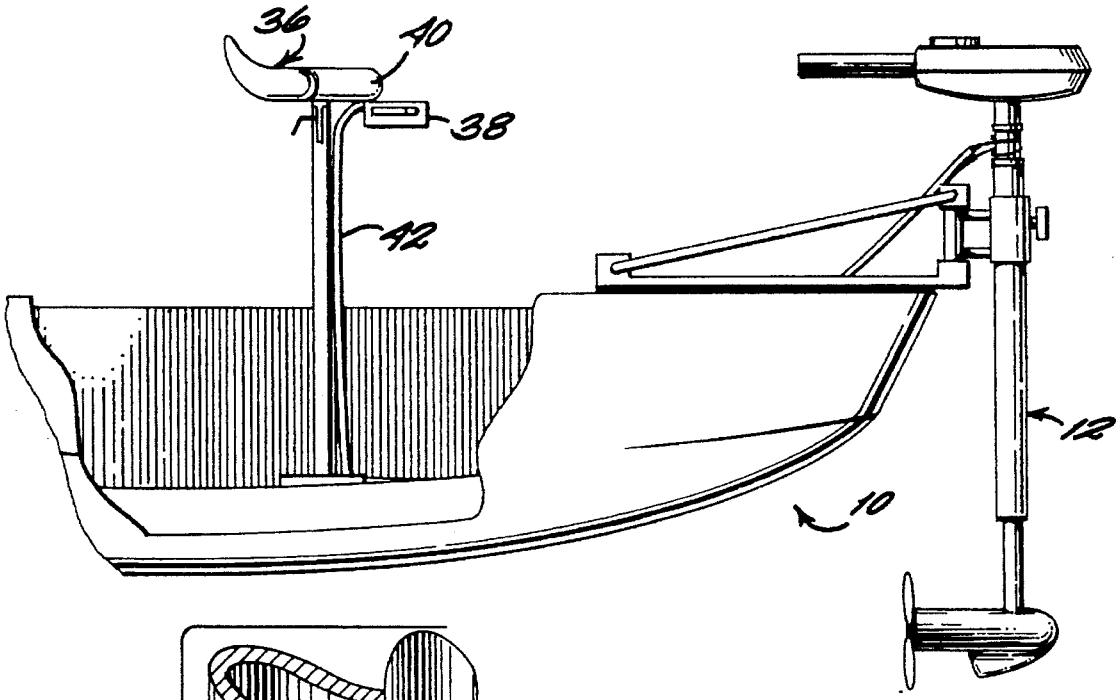
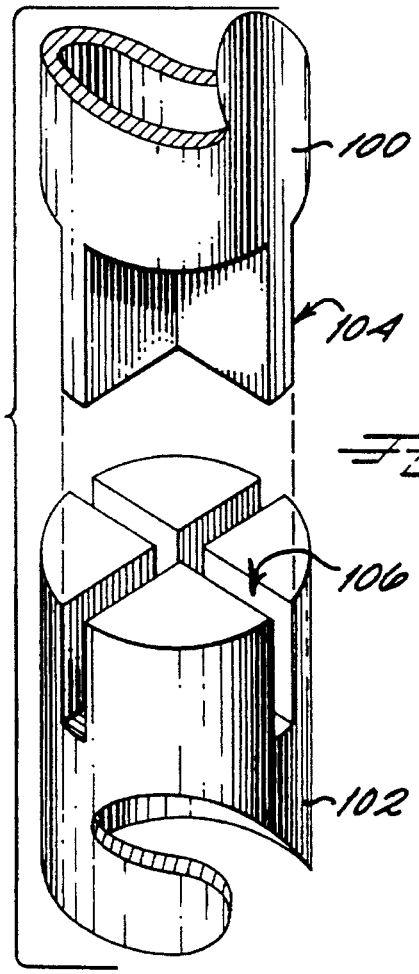
FIG 10

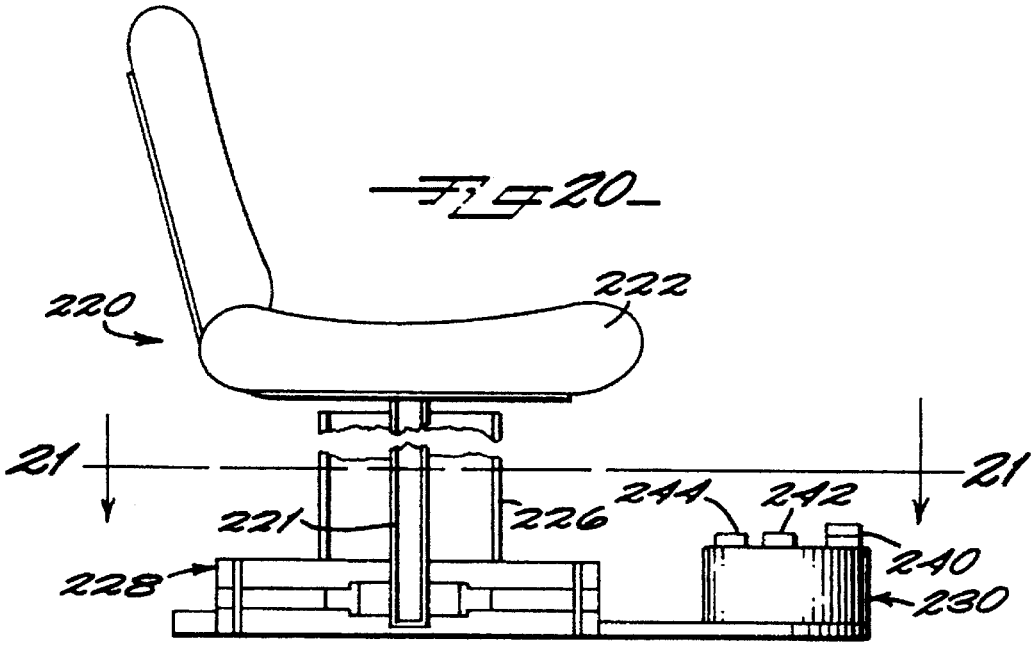
FIG 20
FIG 21
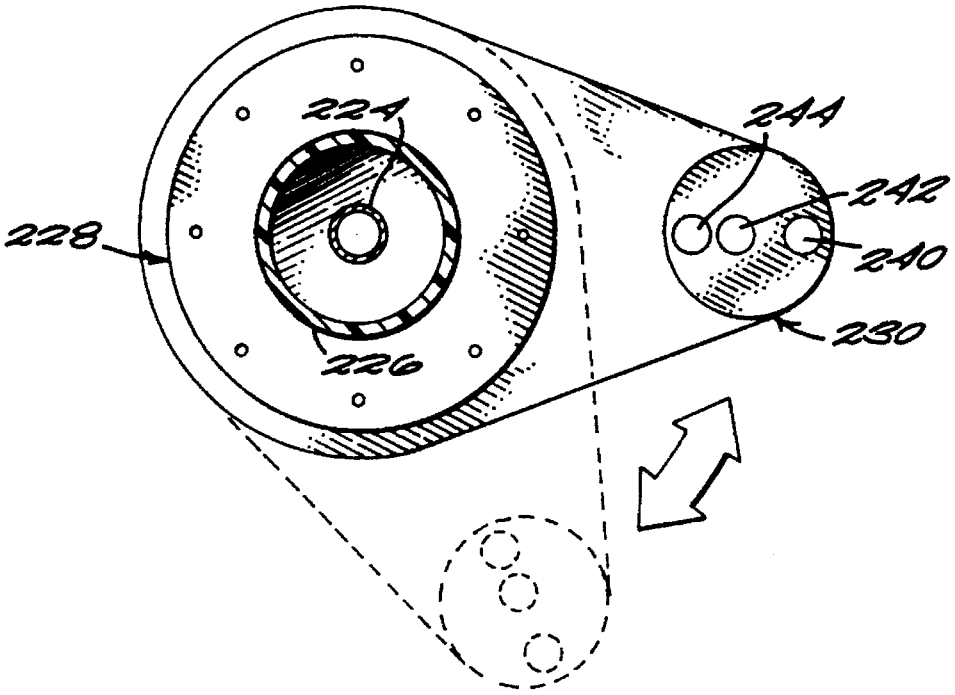

FIG 22
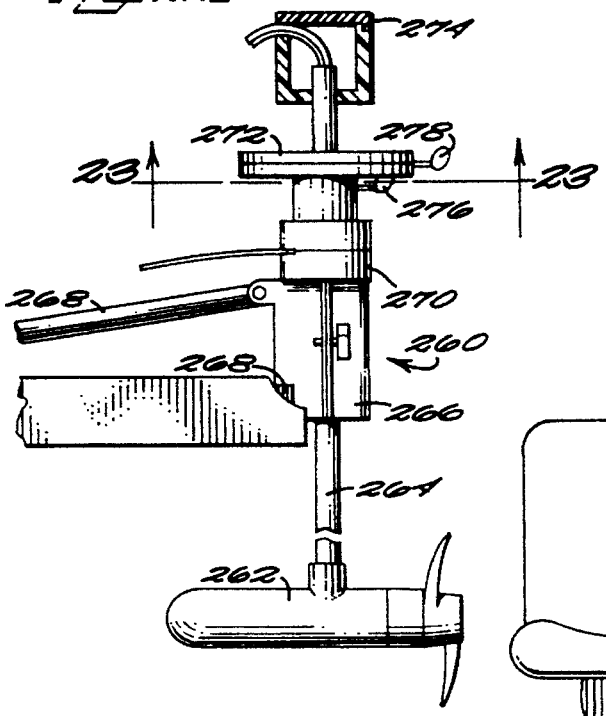
FIG 23
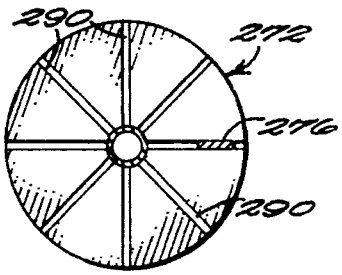
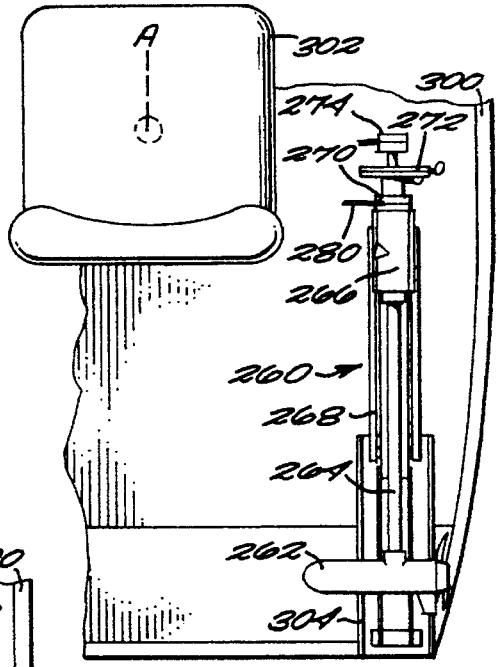
FIG 24A
FIG 24B
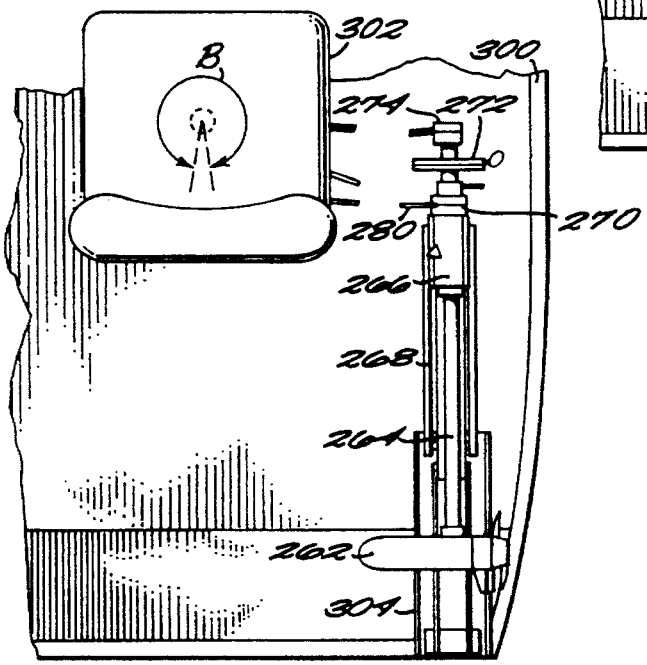

TROLLING MOTOR CONTROL APPARATUS

This application is a continuation-in-part of application Ser. No. 08/164,007, filed Dec. 8, 1993, now abandoned.

BACKGROUND OF THE INVENTION

1. Field of the Invention

The present invention relates to the operation of trolling motors used with fishing boats. In particular, the present invention relates to control of the trolling motor from a chair in the fishing boat.

2. Discussion of Background

Fishing boats come in a variety of styles and with a variety of equipment. A fishing boat may be equipped with an inboard or outboard motor for propelling the boat from place to place on a body of water such as a lake or stream. Many fishing boats also have a trolling motor that is smaller, quieter and less powerful than the outboard motor, for maneuvering the boat slowly across the water in a manner less disturbing to fish. The fisherman can fish while the boat is moved by the trolling motor or after it has stopped. If the boat is in a moving body of water, the trolling motor can be used to maintain or restore the position of the boat.

The trolling motor is controlled from the motor itself or, more conveniently, from foot-operated controls near a swivel chair on the boat. It is steered typically with a tiller, the motor head having an on/off switch, speed control and forward/reverse switch.

There have been attempts to control a trolling motor from the chair by coupling the rotation of the chair to the angle of the motor, but these have proved to be unsatisfactory because the range of motion is limited and because of the potential for the linkages between chair and motor to bind. Furthermore, the force required to turn the motor with a single cable or linkage system can be considerable. Consequently, there remains a need for a way to control a trolling motor from the chair where the fisherman sits.

SUMMARY OF THE INVENTION

According to its major aspects and broadly stated, the present invention is an apparatus for controlling the operation of a trolling motor of a boat. Control refers to starting and stopping the motor, operating the motor in the forward and reverse directions, and changing the speed of the motor. Control is exercised from a chair bearing assembly rotatably mounted in the boat, so that the user can be fishing while standing or seated and still exercise control over the motor. Rotation of the bearing assembly rotates the trolling motor. Rotation is effected through a pair of cables in housings running from a pulley on the bearing assembly to a pulley on the shaft of the trolling motor. As the chair is rotated in one direction or the other, its pulley pulls on one of the cables that, in turn, pulls on the pulley of the motor shaft.

An on/off switch (or, in some embodiments, a forward/off/reverse switch or polarity switch) connected to the trolling motor is mounted to the chair bearing assembly, and is operable preferably either by movement of the foot or the upper leg of the user or the chair. In a preferred embodiment of the invention, the switch is operated by movement of the leg of the user and is biased to the "off" position, so that the user can start the motor by moving his leg against the switch and stop it by moving his leg away from the switch. In another embodiment, the switch is foot controlled and is activated by rocking the foot or stepping on the on-off button, or by the tilting of the chair.

The controls may also contain a speed control and a polarity switch to change the direction the motor operates incorporated into the chair bearing assembly for activation by the user's hand or foot when sitting, standing or leaning against the chair.

The present invention also, in a preferred embodiment, includes means for disconnecting the movement of the chair bearing assembly from the motor so that the chair can be rotated without moving the trolling motor, such as when the motor has been pulled up out of the water.

The rotating of the motor in correspondence with the rotating of the chair is an important feature of the present invention. Furthermore, there are several aspects of this feature that are individually significant. For example, the direction of movement of the boat is reflected in the direction of rotation of the chair; if the chair is rotated to the left, the boat turns to the left; rotating to the right turns the boat to the right. This is especially important when moving in reverse; the user simply rotates the chair so that he can look in the direction he wants to go and the motor rotates so that the boat moves in that direction. Also, the motor will rotate through two arcuate degrees for each arcuate degree of rotation of the chair. This feature is significant for two reasons: first, it enables the user to effect a quick and complete response of the trolling motor with a relatively small rotation of his seat; second, it enables him to fish facing the shore of a stream while the trolling motor propels the boat parallel to the shore, and to have a very good sense of the boat's direction without having to look at the motor to determine its orientation. The user still simply turns his body the way he wants the boat to travel. The specifics of the operation of the chair and trolling motor that produce these advantages will be described more fully below.

The use of two enclosed cables is also an important feature of the present invention. Two cables are less likely to bind than a rigid linkage and, when used to pull on a pulley, will produce smooth movement of the trolling motor in either direction. Furthermore, by reversing the connection of the cables to the pulleys, the direction the motor rotates with respect to the direction the chair rotates can be reversed.

Another feature of the present invention is the use of an "on/off" switch, or preferably, for better control, a "forward/off/reverse" switch or a switch with several forward and reverse positions, mounted to the chair bearing assembly. The switch is positioned so that movement of the user's leg turns the motor on by pressing the knee or thigh against an on-biased switch, stepping on a switch carried by the chair bearing base, or rocking the chair back.

Still another advantage of the present invention is that the control of the motor can be easily decoupled from the movement of the chair. This advantage allows the chair to be rotated without rotating the motor, such as when it is desired to not operate the motor, when the motor is retracted from the water, or simply when the user desires to rotate the chair without rotating the motor.

Yet another feature of the present invention, in one of its embodiments, is the option of orienting the motor in any one of several, preferably eight, different directions with respect to the orientation of the chair.

Other features and advantages of the present invention will be apparent to those skilled in the art of trolling motor control from a careful reading of the Detailed Description of Preferred Embodiment accompanied by the following drawings.

BRIEF DESCRIPTION OF THE DRAWINGS

In the drawings,

FIG. 3 is a side view, partially cut away, of a boat with a trolling motor mounted to the back of the boat and controlled in accordance with another preferred embodiment of the present invention;

FIG. 10 is a detailed, exploded view of the seating of the chair shaft to the bearing in accordance with a preferred embodiment of the present invention;

FIG. 20 illustrates another embodiment according to the present invention where operation of the trolling motor is provided by using a stationary foot control;

FIG. 21, taken along lines 21–21 of FIG. 20, illustrates the foot console of FIG. 20;

FIG. 22 illustrates a side, partially cross sectional view of a trolling motor according to a preferred embodiment of the present invention;

FIG. 23 shows a view, taken along lines 23—23 of FIG. 22, of the direction plate according to a preferred embodiment of the present invention;

FIGS. 24*a* and 24*b* show top views of a portion of a boat, showing a trolling motor in a stowed position with direction plate engaged and disengaged, respectively;

DETAILED DESCRIPTION OF PREFERRED EMBODIMENTS

Figure 1:
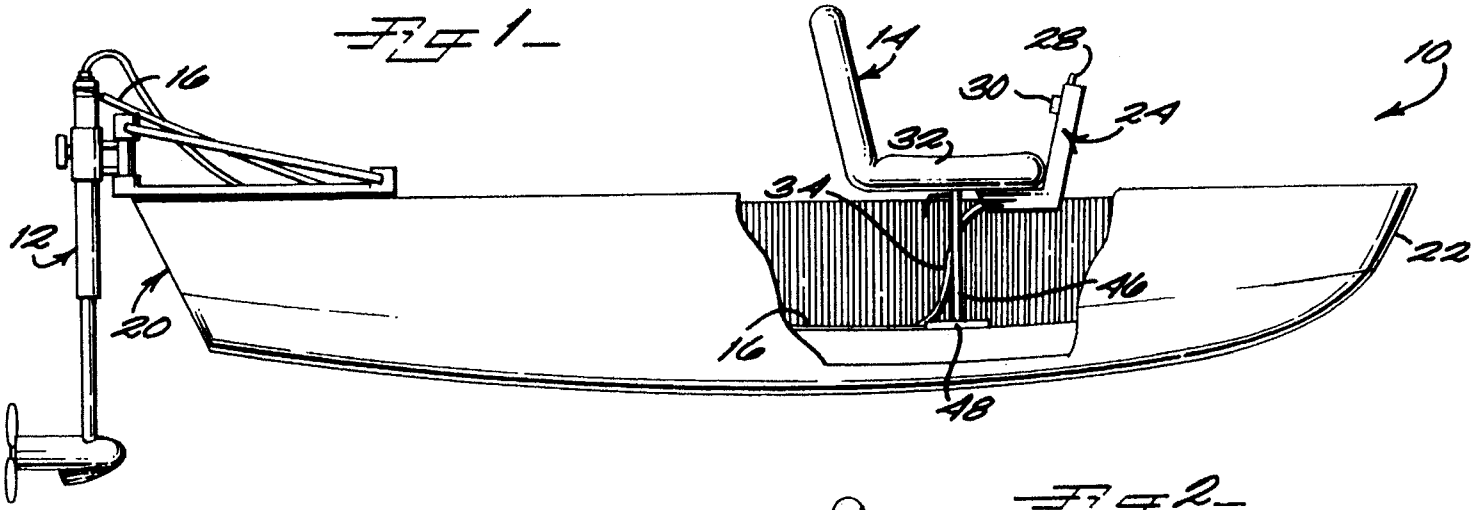
FIG. 1 is a side view, partially cut away, of a boat with a trolling motor mounted to the back of the boat and controlled in accordance with a preferred embodiment of the present invention.

In the following description, like reference numerals refer to and identify the same structures, areas or surfaces as they are used in the different figures.

The present invention is a method and apparatus for controlling the trolling motor of a fishing boat—its activation, direction of orientation, speed and polarity—from the fishing seat, using a variety of techniques that make control convenient for the user when fishing. Generally, a full set of controls for the motor are on the motor. However, away from the motor and sitting on the fishing seat, the user is out of reach of these controls. On a typical fishing boat there is usually a seat, perhaps a "high seat," for use during fishing. The present invention enables complete control of the trolling motor from the seat in a "hands free" mode by using natural lower body movements to start and stop the motor, to adjust speed, and to rotate the motor. Furthermore, the motor can be decoupled from the seat assembly controls simply, so that the user can swivel the chair without moving the motor if desired.

Figure 2:
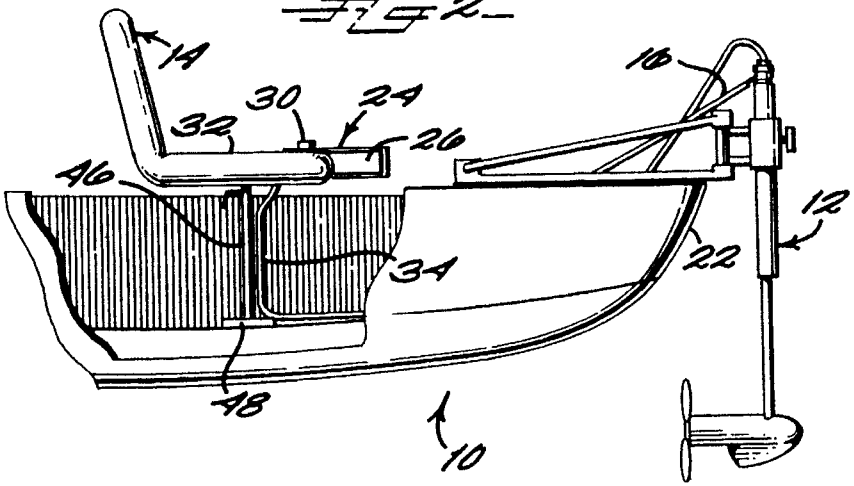
FIG. 2 is a partial side view, partially cut away, of a boat with a trolling motor mounted to the front of the boat and controlled in accordance with a preferred embodiment of the present invention.

FIGS. 1 and 2 illustrate a preferred embodiment of the present invention. In these figures, there is a boat 10 having a battery-operated trolling motor 12 and a swivel chair assembly 14. Swivel chair assembly 14 is connected to trolling motor 12 by a cable assembly 16, to be described in more detail below.

In FIG. 1, trolling motor 12 is mounted to the back 20 of boat 10 where it will push boat 10; in FIG. 2, trolling motor 12 is mounted to the front 22 of boat 10 where it will pull boat 10. The selection of location for motor 12 is based on the type of fishing and personal choice. Typically, boat 10 may also be equipped with an outboard motor or an inboard motor; the motor is not shown and is not part of the present invention.

For controlling motor 12 from chair assembly 14, a control panel 24 is attached to a seat 32 of chair assembly 14.

Control panel 24 includes an "on/off," or preferably a "forward/off/reverse," switch 26 that operates motor 12, a polarity switch 28 that reverses the direction of operation of motor 12, and a speed control switch 30 that allows different speeds of motor 12 to be selected. FIG. 1 illustrates control panel 24 mounted so that it will be between the knees of a user. Control panel 24 is connected electrically to trolling motor 12 by an electrical cable 34. FIG. 2 illustrates an alternative embodiment where control panel 24 is mounted to the side of seat 32 where it will be just outside the left knee of the user. FIG. 3 shows still another embodiment of the present invention where a high swivel chair 36 has a control panel 38 mounted to a seat 40 for a fisherman to be seated higher than in the case of seat 32. Control panel 38 is positioned to be between the thighs of the user when the user is leaning against seat 40 and is connected to trolling motor 12 by an electrical cable 42. Preferred, alternative embodiments of the present invention for use with a high swivel chair or with the chair removed will be described below.

Figure 4:
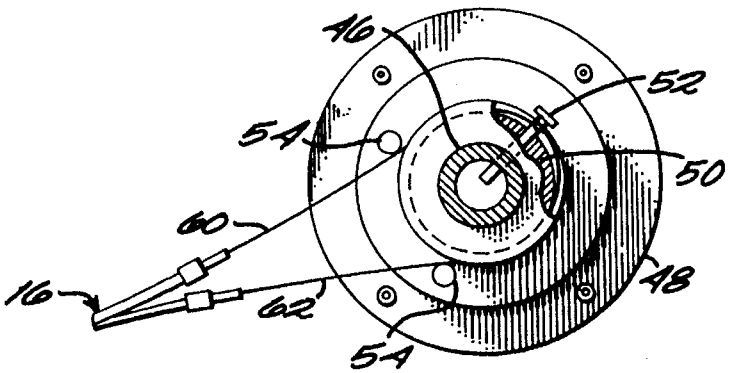
FIG. 4 is a top, partially cut away view of the pulley on the shaft of the chair in accordance with a preferred embodiment of the present invention.
Figure 5:
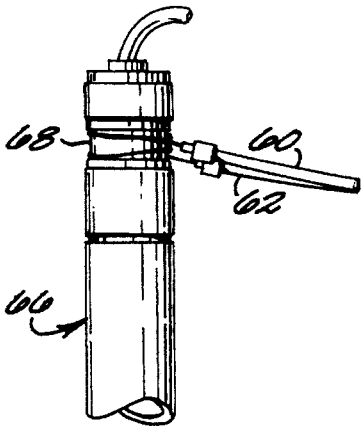
FIG. 5 is a side view of the pulley of the shaft of the trolling motor in accordance with a preferred embodiment of the present invention.

FIGS. 4 and 5 illustrate the details of the attachment of cable assembly 16 to swivel chair assembly 14 and trolling motor 12. Swivel chair assembly 14 has a shaft 46 that rotates with respect to boat 10 in a bearing assembly 48. Attached to shaft 46 and rotatable therewith is a pulley 50. Pulley 50 has a bolt 52 that travels between two stops 54. When bolt 52 reaches either stop 54, it can go no further. Stops 54, in this embodiment, are approximately 270 degrees apart to give swivel chair assembly 14 approximately 270 degrees of rotation or approximately 135 degrees of rotation to the left and to the fight of a forward facing position. Obviously, a single stop 54 can be used in lieu of two stops for as much as 350° of rotation of assembly 14 and twice that, 700° rotation, of trolling motor 12.

A pair of cables, a first cable 60 and a second cable 62, run around the circumference of pulley 50 at least as far as bolt 52, as shown, and preferably somewhat farther to maintain tension on cables 60, 62 throughout their full range of motion. These cables are brought together to travel to trolling motor 12 via cable assembly 16. It will be clear that as pulley 50 rotates in one direction, it pulls first cable 60 and, when pulley 50 rotates in the opposite direction, it pulls second cable 62.

Trolling motor 12 also has a shaft 66 with a pulley 68. First cable 60 and second cable 62 are connected to shaft 66 in a fashion similar to that used to connect them to pulley 50, except that first cable 60 is higher on shaft 66 than second cable 62 to prevent cable fouling. Preferably, for reasons that will be set forth presently, the ratio of the diameter of pulley 50 to pulley 68 is approximately two so that, for each degree of rotation of pulley 50, pulley 68 rotates two degrees. However, other ratios may be used if desired.

Figure 6:
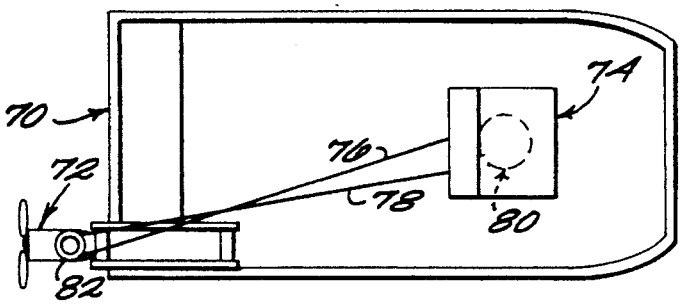
FIG. 6 is a top view of a boat with a trolling motor mounted to the back of the boat and controlled in accordance with the present invention.

FIG. 6 and FIGS. 7*a*–7*e* illustrate the specific operation of the present invention and its advantages. FIG. 6 shows a boat 70 with a motor 72 mounted on the back. Swivel chair assembly 74 is facing forward; motor 72 is facing forward so that it can propel boat 70 forward. Cables 76 and 78 are shown crossing as they run from a first pulley 80 rotating with chair assembly 74 to a second pulley 82 rotating with motor 72.

Figure 7A:
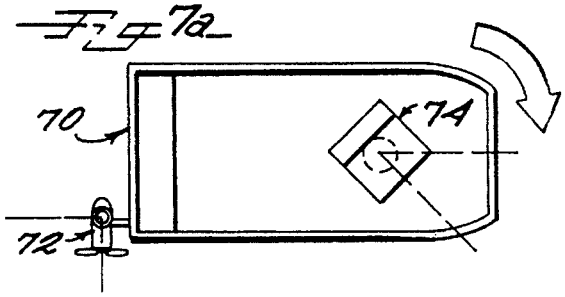
FIGS. 7*a–e* depict the boat of FIG. 6 illustrated with the seat rotated and the trolling motor polarity set in several different configurations.

FIG. 7*a* illustrates chair assembly 74 rotated to the right. A fight rotation of chair assembly 74 rotates motor 72 to face to the left where it will push boat 70 so that it swings to the fight, in the direction chair assembly 74 was rotated. Because of the two-to-one rotation of motor 72 to chair assembly 74, a 45° rotation of chair assembly 74 produces a 90° rotation of motor 72.

Figure 7B:
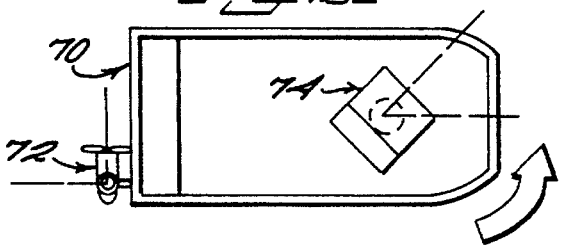

FIG. 7*b* shows a rotation of chair assembly 74 to the left by 45° with a corresponding rotation of motor 72 to face the fight by 90°, where it will push boat 70 to the left, again in the direction chair assembly 74 has been rotated.

Figure 7E:
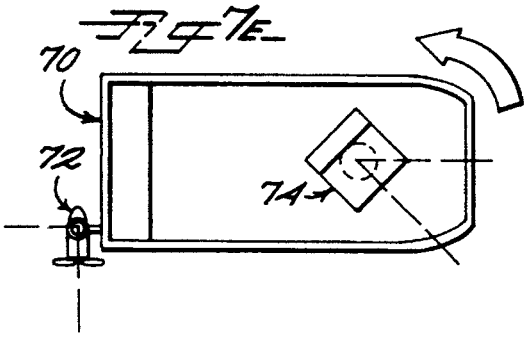
Figure 7C:
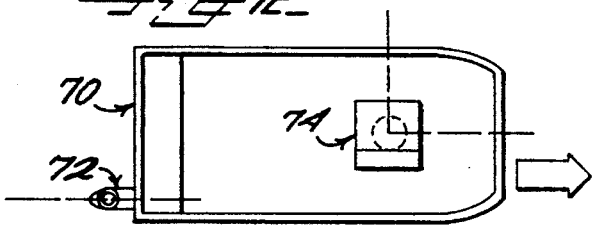
Figure 7D:
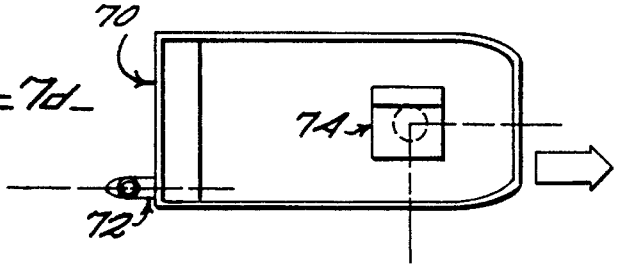

By rotating chair assembly 74 by 90° to either side of boat 70 so that motor 72 rotates 180°, as shown in FIGS. 7*c* and 7*d*, and reversing the polarity of motor 72 using switch 28 on control panel 24 (see FIG. 1 ), the user can fish to the side of boat 70 while it moves forward and parallel to the shore or maintain a position parallel to the shore and headed into a stream current. Finally, as seen in FIG. 7*e*, in backing up boat 70, the polarity of motor 72 is reversed, using switch 28, and chair assembly 74 is rotated so that the user can look over his shoulder in the direction he wants boat 70 to go. Motor 72 rotates boat 70 as indicated by the arrow and moves it backwards, thus turning boat 70 to the left, as illustrated when chair assembly 74 is rotated to the right, resulting in an overall movement of boat 70 rearward and to the right.

Figure 8:
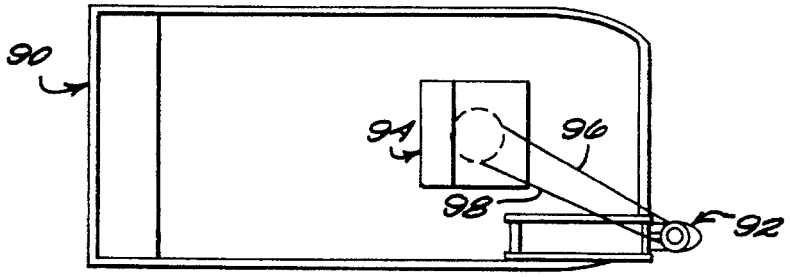
FIG. 8 is a top view of a boat with a trolling motor mounted to the front of the boat and controlled in accordance with the present invention.
Figure 9A:
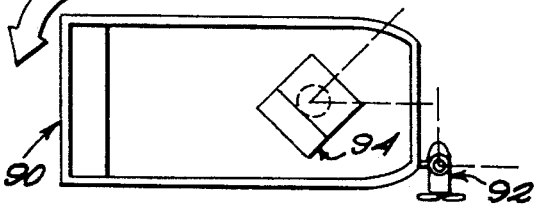
FIGS. 9*a–e* depict the boat of FIG. 8 illustrated with the seat rotated and the trolling motor polarity set in several different configurations.
Figure 9B:
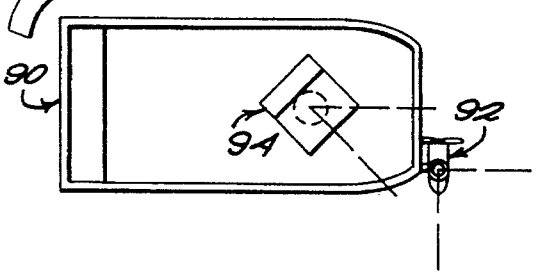
Figure 9C:
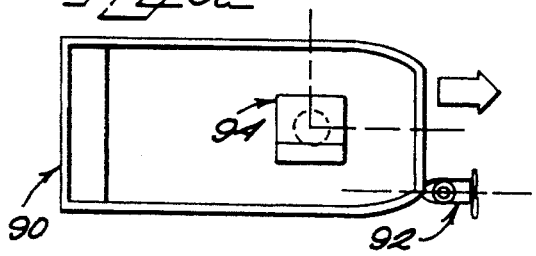
Figure 9D:
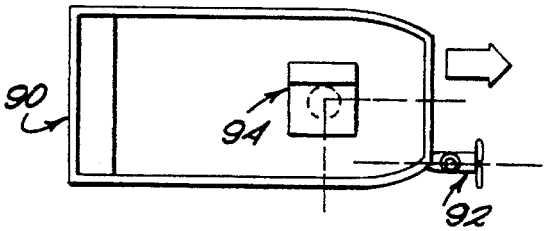

FIG. 8 illustrates a boat 90 with a motor 92 mounted in the front and connected to a swivel chair assembly 94 by a first cable 96 and a second cable 98. First and second cables 96, 98, do not cross because motor 92 will turn in the same direction as chair assembly 94. As seen in FIGS. 9*a* and 9*b*, rotation of chair assembly 94 to the left causes motor 92 to rotate to the left, where it rotates boat 90 to the left corresponding to the direction of rotation of chair assembly 94; rotation of chair assembly 94 to the fight rotates motor 92 to the right, rotating boat 90 to the right, too. As with a rear-mounted motor, rotation of chair assembly 94 by 90° to either side of boat 90, thereby rotating motor 92 by 180°, and reversing the polarity of motor 92 with switch 28, will enable fishing from the side of boat 90 as it is propelled parallel to shore, as illustrated in FIGS. 9*c* and 9*d*.

Figure 9E:
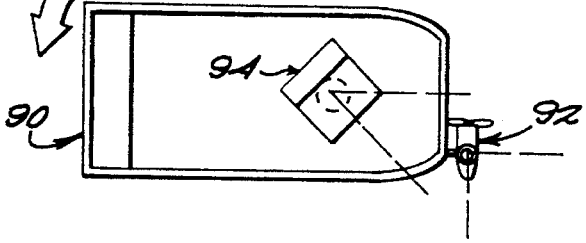

Backing up is performed as with a rear-mounted motor: the user rotates chair assembly 94, as shown in FIG. 9*e*, so that he can look over his shoulder in the direction he desires to move boat 90, with polarity switch 28 in reverse position.

FIG. 10 illustrates a coupling for a swivel chair shaft 100 to a bearing 102. The end of shaft 100 has a cruciform shape 104 and fits into a corresponding double grooved recess 106 in bearing 102. This coupling enables a secure mating of shaft 100 and bearing 102 but allows the chair to be lifted and rotated to the side, if the user wants to propel the boat with normal rather than reverse polarity while fishing from the side of the boat.

Figure 11A:
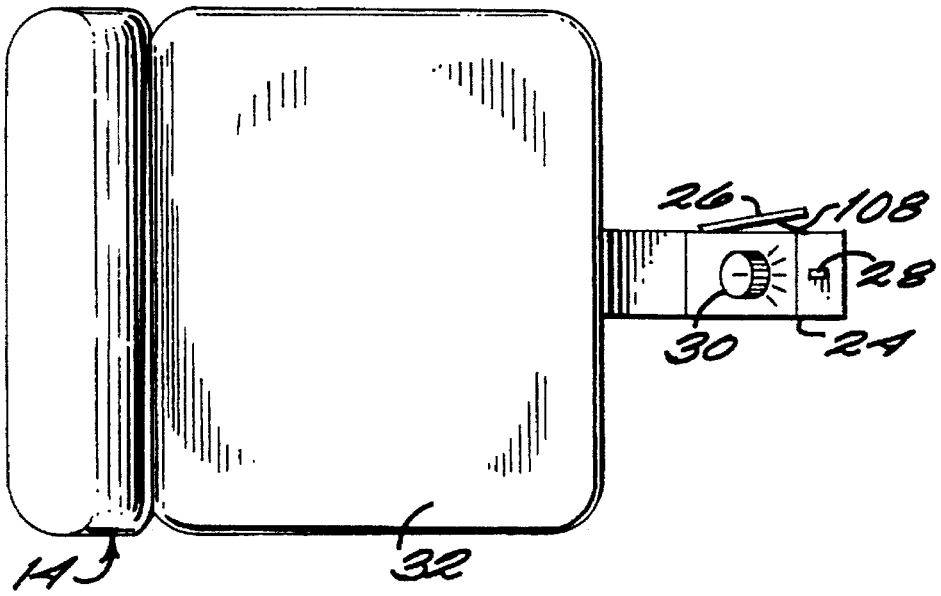
FIGS. 11*a* and 11*b* are detailed illustrations of a top and side view, respectively, of a control panel according to a preferred embodiment of the present invention.
Figure 11B:
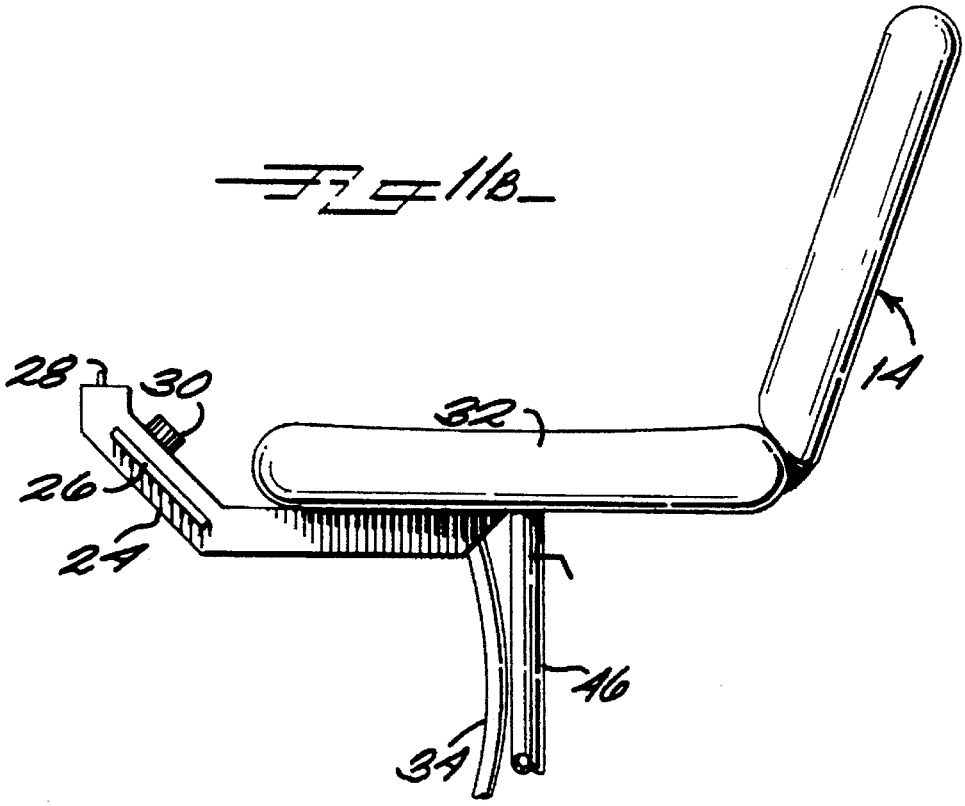

FIGS. 11*a* and 11*b* illustrate control panel 24 in more detail. Control panel 24 is shown attached to the middle of seat 32 so that on/off switch 26 is adjacent a user's knee on the inside of the leg, where movement of the leg presses switch 26 against a spring 108 to move switch 26 from the "off" position to the "on" position. This is, of course, a safety feature because it requires pressure against switch 26 to keep the motor operating. It also enables the user to have effortless control over the boat while leaving both hands free to handle fishing equipment. Control panel 24 also has polarity switch 28 and speed control switch 30. Speed control switch 30 can be of the type where specific speeds are selected from a number of choices or it may be a continuous speed control switch, similar to a rheostat. On/off switch 26, polarity control switch 28 and speed control switch 30 are connected to motor 12 (FIG. 1 ) via a cable 34 and are in series with a battery (not shown) for operating motor 12.

Figure 12:
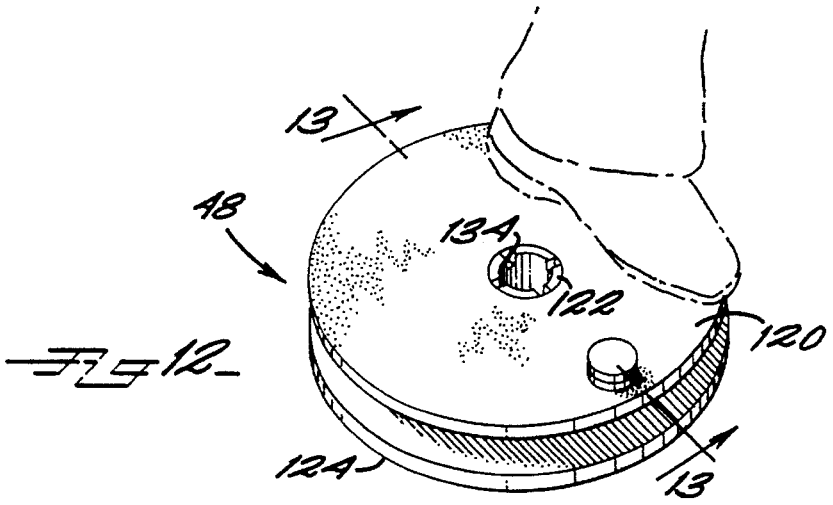
FIG. 12 illustrates the bearing and an alternative embodiment of engagement with the shaft of the chair according to the present invention.
Figure 13:
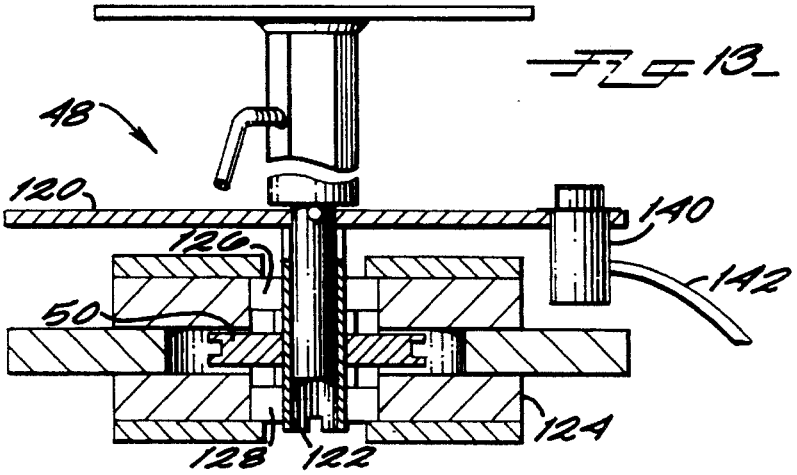
FIG. 13 illustrates a perspective view of an alternative means for controlling the trolling motor in accordance with the present invention.

FIGS. 12 and 13 illustrate bearing assembly 48 of the present invention in cross section. Bearing assembly 48 comprises a top plate 120 surrounding an interior shaft 122 which turns freely within top plate 120. Pulley 50 is welded to shaft 122 so that pulley 50 rotates with shaft 122. Bearing assembly 48 has a bearing housing 124 having two bearings 126, 128 in engagement with shaft 122 so that shaft 122 rotates freely within bearing housing 124.

Figure 14:
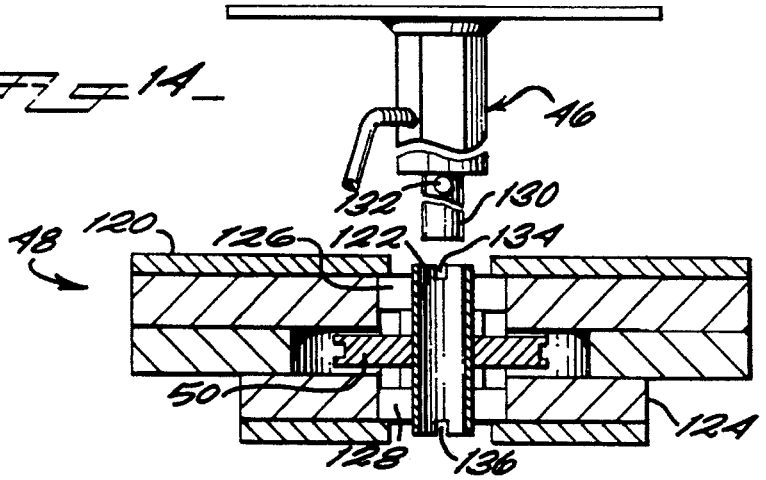
FIG. 14 illustrates a side, cross sectional view of the alternative means for controlling the trolling motor illustrated in FIG. 13.

Shaft 46 in FIG. 14 terminates in a reduced diameter portion 130 having a set of pins 132 located 180° apart. Interior shaft 122 has four recesses 134 at its upper end that receive pins 132 and lock chair shaft 46 and interior shaft 122 together rotationally, but allow chair 14 to be lifted and rotated 90° for fishing from the side of boat 10. Interior shaft 122 may also have four recesses 136 at its other end so that, rather than reversing the cables 60, 62, chair 14 can be removed temporarily and bearing assembly 48 can simply be turned upside down to uncross cables 60, 62 and chair assembly 14 repositioned.

In an alternative or additional embodiment, top plate 120 can carry an on/off switch 140 (or a forward/off/reverse switch having one or more forward positions and one or more reverse positions) that operates by pressing with the foot when a user wants to move chair assembly 14 and control boat 10 while standing up. Switch 140 is connected to motor 12 by a cable 142 and is preferably biased to an open or off position. Simply by placing his foot on switch 140 on top plate 120, pressing switch 140 to activate motor 12 and then rotating his foot to steer boat 10, the user can maneuver boat 10 as desired.

To provide for switch 140, top plate 120 is elevated and welded to a longer interior shaft 122, as illustrated in FIG. 14, so that plate 120 can rotate shaft 122, but otherwise can operate in the above-described fashion. This embodiment is suited for a front mounted motor, where the speed control switch and reverse polarity switch are on the motor, but the motor is within reach of bearing assembly 12 with or without chair assembly 14. Chair assembly 14 can be used for control when seated in the bearing assembly or it can be removed and the rotation of top plate 120 used to control boat 10.

Figure 15:
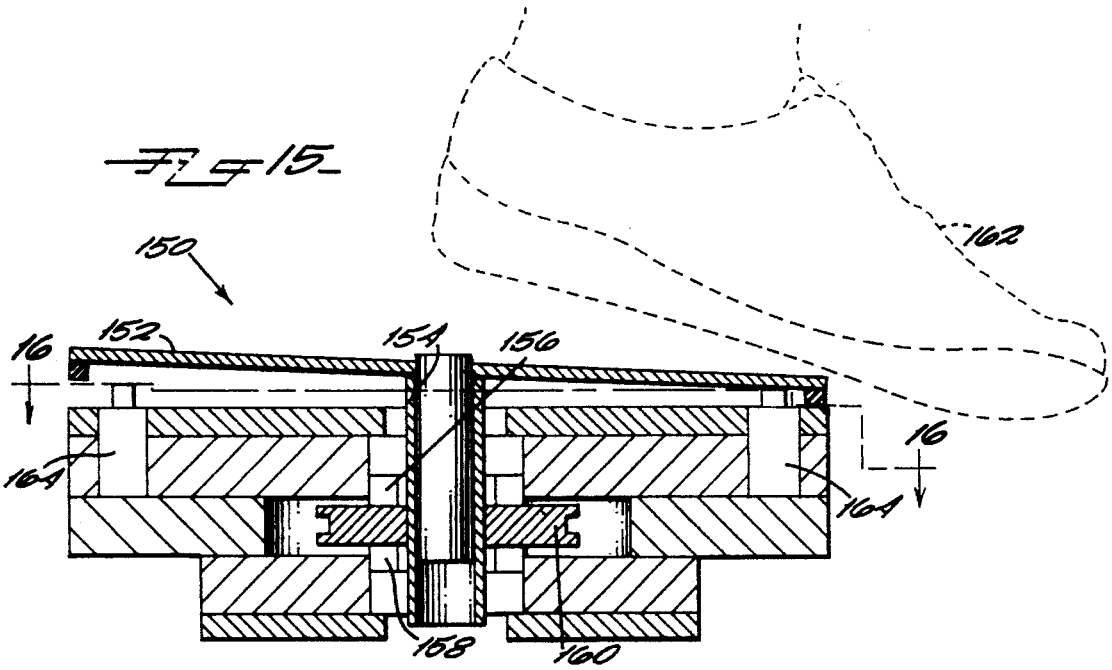
FIG. 15 illustrates a side, cross sectional view of another alternative means for controlling the trolling motor according to a preferred embodiment of the present invention.
Figure 16:
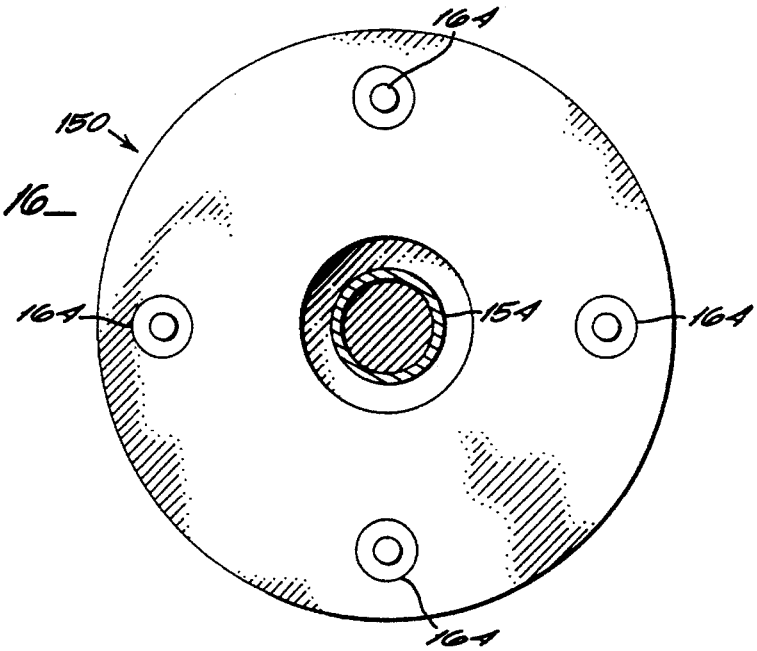
FIG. 16 illustrates the alternative controlling means shown in FIG. 15 and taken along lines 16—16.

In still another embodiment of the present invention, there is illustrated in FIG. 15 a side, cross-sectional view of a bearing assembly 150 having a top plate 152 surrounding an interior shaft 154 that rotates freely against two bearings 156, 158, to rotate a pulley 160. In this embodiment, as in that illustrated in FIGS. 12 and 13, bearing assembly 150 is rotated using a foot 162. However, instead of one switch that is operated by pressing foot 162 directly on switch 140, there are several switches 164, preferably four switches as illustrated in FIG. 16, that are activated by pressing down anywhere along the edge of top plate 152. Switches 164 are trolling motor on/off switches. Pressing on top plate 152 a first time will activate trolling motor 12; pressing a second time will deactivate trolling motor 12.

In the embodiment illustrated in FIG. 15 and FIG. 16, use of a chair is optional. If a chair is used, it seats into interior shaft 154 and can be used to rotate bearing assembly 150 rather than rotating the bearing assembly with foot 162, but operating switches 164 is still done by foot 162.

Figure 17:
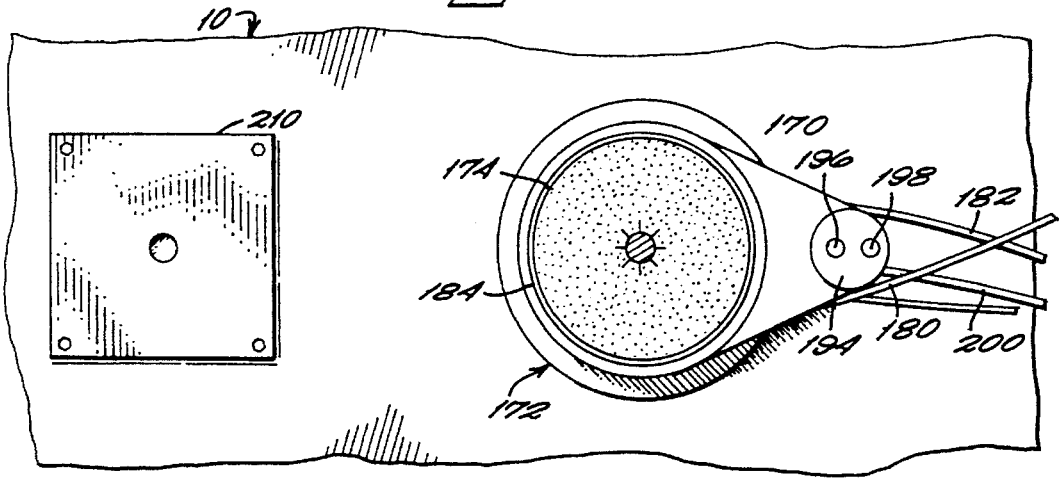
FIG. 17 is a partial top view of a boat with a trolling motor mounted to the front of the boat and controlled in accordance with another preferred embodiment of the present invention, wherein the chair location can be altered from a first control position to a second control position.
Figure 18:
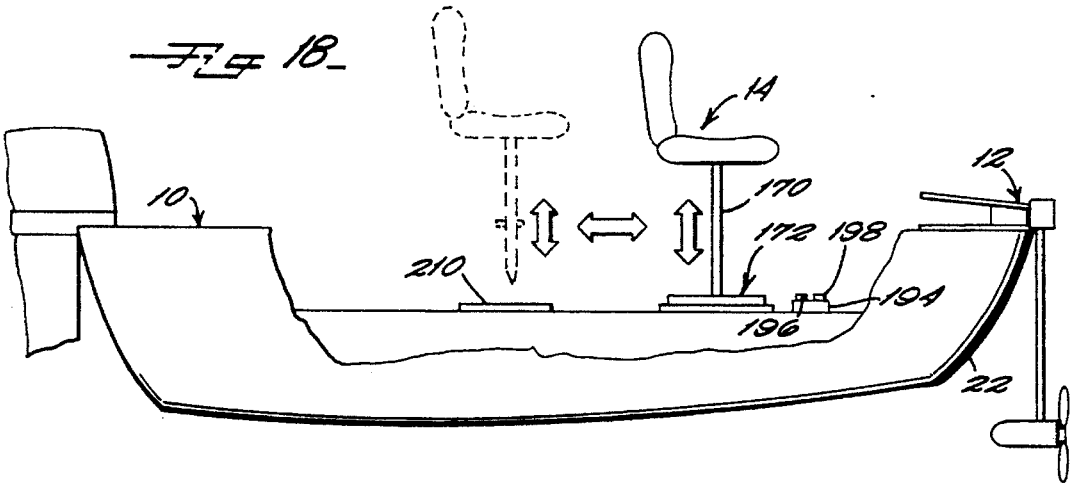
FIG. 18 is a side view, partially cut away, of a boat with first and second chair control positions of FIG. 17.
Figure 19:
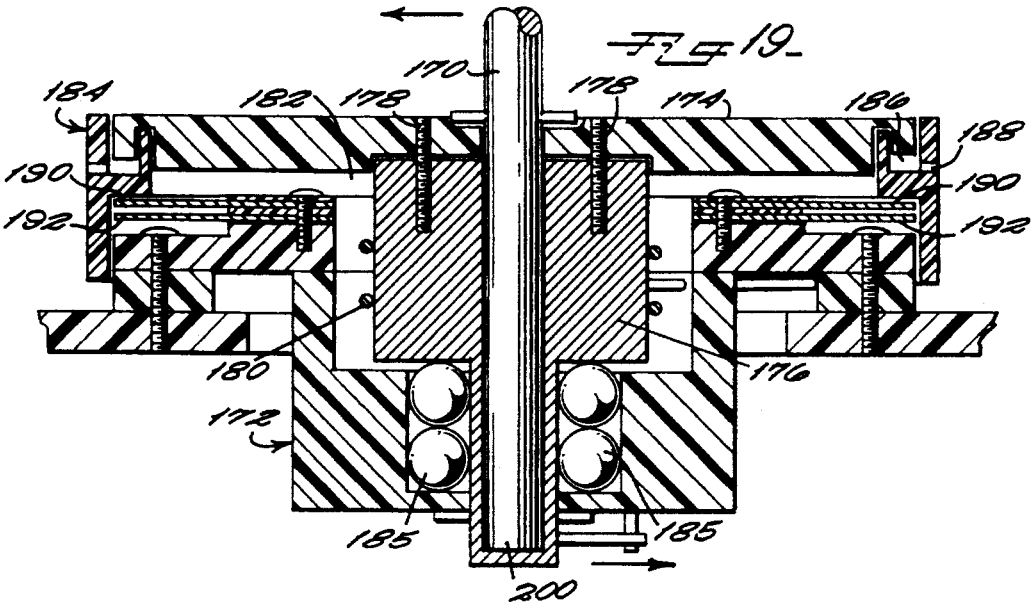
FIG. 19 is a detailed, cross-sectional view of the seating of a portion of the chair shaft in the bearing assembly as also shown in FIGS. 17 and 18.

FIGS. 17, 18 and 19 illustrate still another embodiment of the present invention. In FIG. 18, trolling motor 12 is shown mounted to front 22 of boat 10 where it will pull boat 10. Alternatively, trolling motor 12 may be mounted to the back of boat 10 where it will push the boat. Swivel chair assembly 14 has a shaft 170 that rotates with respect to boat 10 in a bearing assembly 172. In the embodiment illustrated in these figures, the trolling motor on/off switch can be activated when the user presses with his foot on a part of the bearing assembly or by tilting the chair, as will be described presently.

Bearing assembly 172 includes a plate 174, preferably made of a stiff material, such as metal or a rigid plastic, and, as with above-described bearing assembly 48, a pulley 176 (FIG. 19) attached to shaft 170 by bolts 178 and rotatable therewith, and a pair of cables 180, 182 lead to trolling motor 12. Pulley 176 rotates freely against bearings 185. Bearing assembly 172 has a flexible, resilient housing 184, preferably made of plastic, that has three functions. First, housing 184 enables the trolling motor to be turned on when the user presses down on it with the heel of a foot. Second, housing 184 protects the interior of bearing assembly 172 from water by an annular water channel 186 that catches water and directs it from housing 184 through holes 188. Finally, housing 184's third function is to allow the user's foot to remain in one position in relation to the floor when seated and activating the on/off switch with the heel of the foot. When pressed, housing 184 will not rotate, but remains in stationary contact with the heel when chair assembly 14 is rotated. Therefore, the user's foot that operates the on/off switch controlled by housing 184 does not have to rotate with the chair and both feet can be used to push on the deck of boat 10 to turn chair assembly 14.

When the user is standing or has a foot on both plate 174 and housing 184, bearing assembly 172, including both plate 174 and housing 184, rotate together to rotate trolling motor 12 in steering boat 10. However, bearing assembly 172 includes two disk contacts 190, 192, that are normally spaced apart but, when housing 184 is pressed by the heel of the user's foot to deflect it with respect to plate 174, contacts 190, 192 come together and complete an electrical circuit connected with trolling motor 12. Completing or closing the circuit results in activation of trolling motor 12. Because disks 190, 192 are biased apart, housing 184 must be pressed to keep trolling motor activated. Alternatively, the circuit is closed by making contact between disks 190 and 192, once closed by pressing plate 184, it could be configured to remain closed, notwithstanding the release of foot plate 174, until contact between disks 190, 192 is again made. Thereupon, the circuit could be opened until contact between disks 190, 192 is made.

Motor 12 can also be activated by tilting chair 14, either by leaning back on it when seated or by pressing back on it when standing. When the user flits chair 14, shaft 170 is deflected sideways, as indicated at the top of FIG. 19, thereby deflecting plate 184 in a corresponding direction, but bottom of bearing assembly 172 then moves in the opposite, sideways direction, as indicated at the bottom of FIG. 19. When assembly 172 internal components are made of resilient, flexible materials that flex, disks 190 and 192 will make contact if chair 14 is tilted far enough.

As also seen in FIGS. 17, 18, and 19 a stationary foot control 194 includes a pushbutton 196 for polarity, which changes the direction of operation of trolling motor 12 from forward to reverse, and a knob 198 for speed control. Foot control 194 is connected electrically by cable 200 to trolling motor 12 and does not rotate with bearing assembly 172.

If desired, a base 210 can be provided for seat assembly 14 that is spaced apart from bearing assembly 172 when the user wants to control the movement and operation of trolling motor 12 entirely by foot, either while standing or while seated in a chair not coupled to the orientation of trolling motor 12. To change locations of seat assembly 14, it is simply lifted from bearing assembly and moved to base 210.

Figure 26:
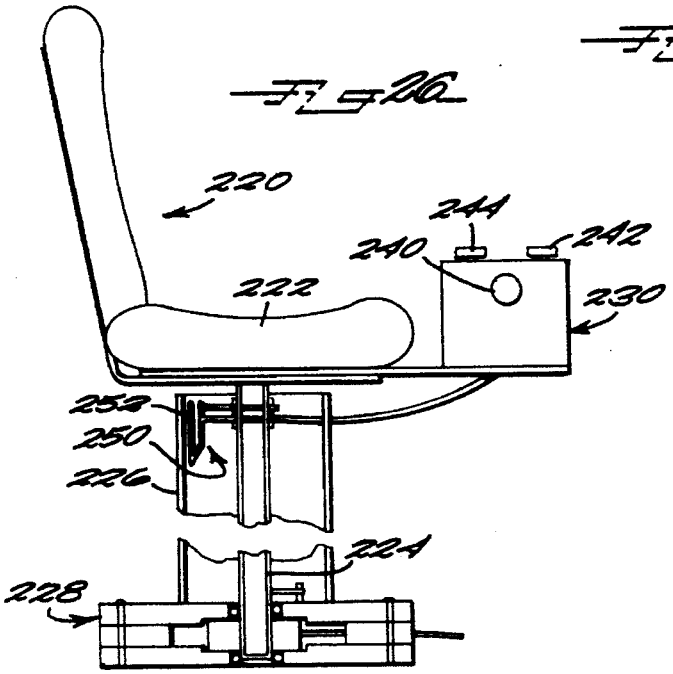
FIG. 26 is a partial cross sectional, side view of a chair bearing assembly that can be tilted to activate the trolling motor in accordance with a preferred embodiment of the present invention.

FIGS. 20, 21 and 26 illustrate still another embodiment of a seat assembly 220 according to the present invention. In this embodiment, seat assembly 220 has a seat 222 mounted onto a shaft 224 inside of a cylindrical housing 226 on a bearing assembly 228. Seat assembly includes a rotating control panel 230 attached either to bearing assembly 228, as illustrated in FIGS. 20 and 21, or to seat 222, as shown in FIG. 26. When attached to bearing assembly 228, control panel 230 is operated by the user's foot (or hand); when attached to seat 222, control panel is operated by the user's hand and upper leg. In both configurations, control panel 230 can be rotated with respect to seat assembly 220, as illustrated by the arrow in FIG. 21.

Control panel 230 includes an on/off switch 240 to activate motor, a polarity switch 242 for motor direction, and a speed control knob 244. In both embodiments, that shown in FIGS. 20 and 21 and that shown in FIG. 26, the on/off switch are preferably of the type that are depressed and kept depressed to keep trolling motor 12 operating, but, alternatively, are of the type that are pushed once to turn motor 12 on and then pushed a second time to turn motor 12 off. Also in both embodiments, rotation of bearing assembly 228 will rotate trolling motor 12.

In the embodiments of the present invention shown in FIGS. 19 and 26, additional control for starting and stopping is available by tilting seat 222. A contact switch 250 (see FIG. 26) located within cylindrical housing 226 is closed when seat 222 is tilted. Contact switch 250 comprises a pair of leads 252 secured to shaft 224. As seat 222 is tilted, leads 252 move toward housing 226. One of leads 252 is angled so that it will contact the other lead 252 when its motion is stopped by housing 226, which remains rigidly in place on bearing assembly 228. A slight but sufficient tilt to close switch 250 will cause the activation of trolling motor 12 as long as seat 222 is kept tilted. A more extensive tilt results in switch 250 maintaining trolling motor in operation until seat 222 is tilted to the same extend a second time, which opens the circuit driving trolling motor 12.

Figure 27:
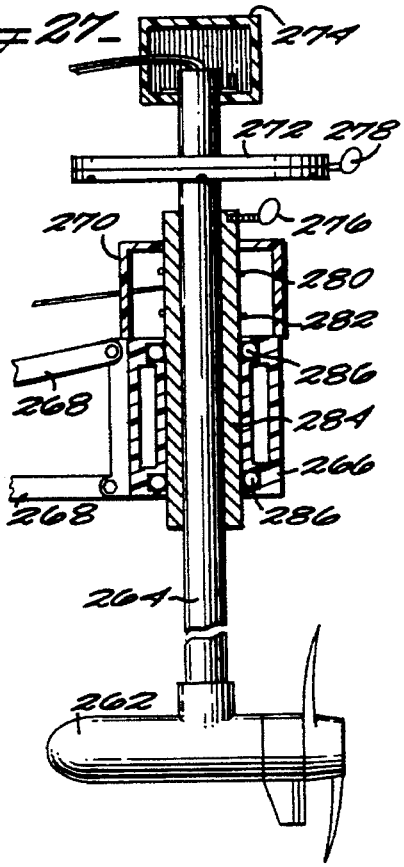
FIG. 27 is a side, cross sectional view of a trolling motor with the motor in a decoupled position according to a preferred embodiment of the present invention.

There will be times when it will be desirable to disconnect or decouple the trolling motor from the seat assembly control, for example, such as when the trolling motor is to be retracted from the water and into the boat. The present invention includes a simple system for decoupling the two, as illustrated in FIGS. 22, 23, 24*a* and 24*b*, 25*a* and 25*b*, and 27. FIGS. 22 and 27 show comparable views of a trolling motor 260 oriented as if in use and having a propeller assembly 262, a shaft 264, a housing 266, retraction linkages 268, a pulley housing 270, a direction plate 272 and an end cap 274. Additionally, a first key 276 is used to couple pulley 284 and direction plate 272; a second key 278 is used to indicate the orientation of propeller assembly 262.

The propeller of propeller assembly 262, which contains an electrical motor (not shown), is oriented via shaft 264 turned by cables 280 and 282 wound about pulley 284 in pulley housing 270, shown in cross section in FIG. 27. Pulley 284 turns freely against bearings 286 in housing 266 and shaft 264 is free to slide vertically within pulley 284, and is shown lifted in FIG. 27 from the coupled position of FIG. 22 to a decoupled position. Pulley 284 and shaft 264 are coupled when first key 276 is turned so that it engages slots 290 in direction plate 272 (FIG. 22 and 23) which couples direction plate 272 to pulley 284, and, therefore, couples the seat assembly to the trolling motor 260.

Figure 25A:
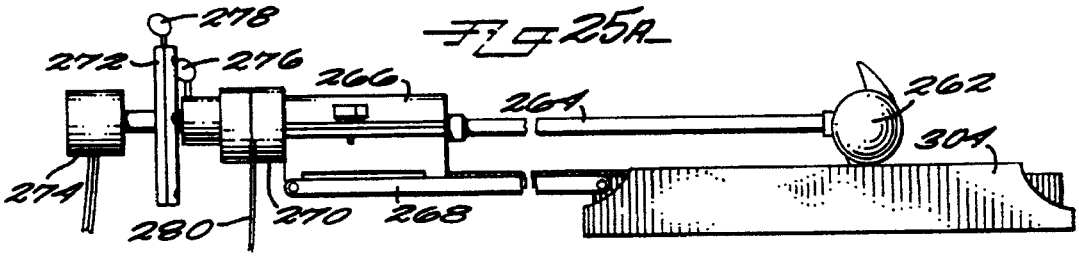
FIGS. 25*a* and 25*b* show side views of the trolling motor with the direction plate engaged and disengaged, respectively, according to a preferred embodiment of the present invention.
Figure 25B:
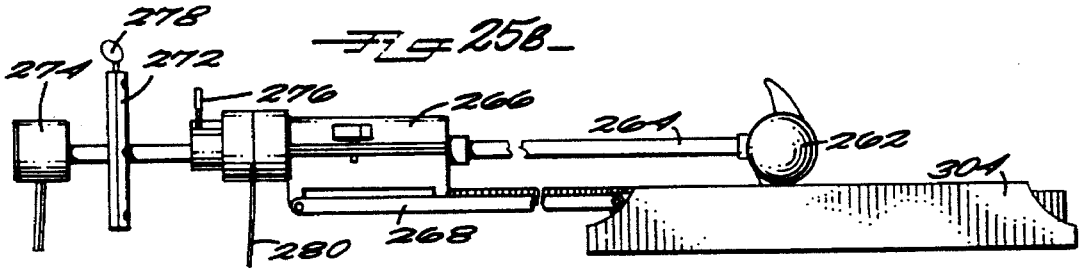

FIGS. 24*a* and 24*b* and FIGS. 25*a* and 25*b* illustrate trolling motor 260 in the retracted position. FIGS. 24*a* and 24*b* are a top view of a portion of a boat 300 with trolling motor 260 retracted; FIGS. 25*a* and 25*b* are side views of trolling motor 260 in retracted position. FIGS. 24*a* and 25*a* correspond to each other and show the direction plate 272 of trolling motor 260 in position where it is coupled to pulley 284 so that trolling motor 260 is coupled to chair 302, and therefore, because trolling motor 260 is laying in a cradle 304 and not free to rotate, chair 302 is locked in place. FIGS. 24*b* and 25*b* also correspond to each other and show direction plate 272 decoupled from pulley 284 so that trolling motor 260 is decoupled from chair 302, thereby allowing chair 302 to rotate freely about a large angle B, as indicated. When first key 276 is turned sideways so that it cannot engage slots 290, direction plate 272 can be in engagement with pulley 284, rather than separated by sliding shaft as illustrated, and the two will not be coupled except for a small amount of friction. Second key 278 always indicates the orientation of propeller assembly 262. Note also that there are a plurality of slots 290 formed in the underside of direction plate 272, allowing the relative orientation of chair 302 and trolling motor 260 to be changed.

Figure 28A:
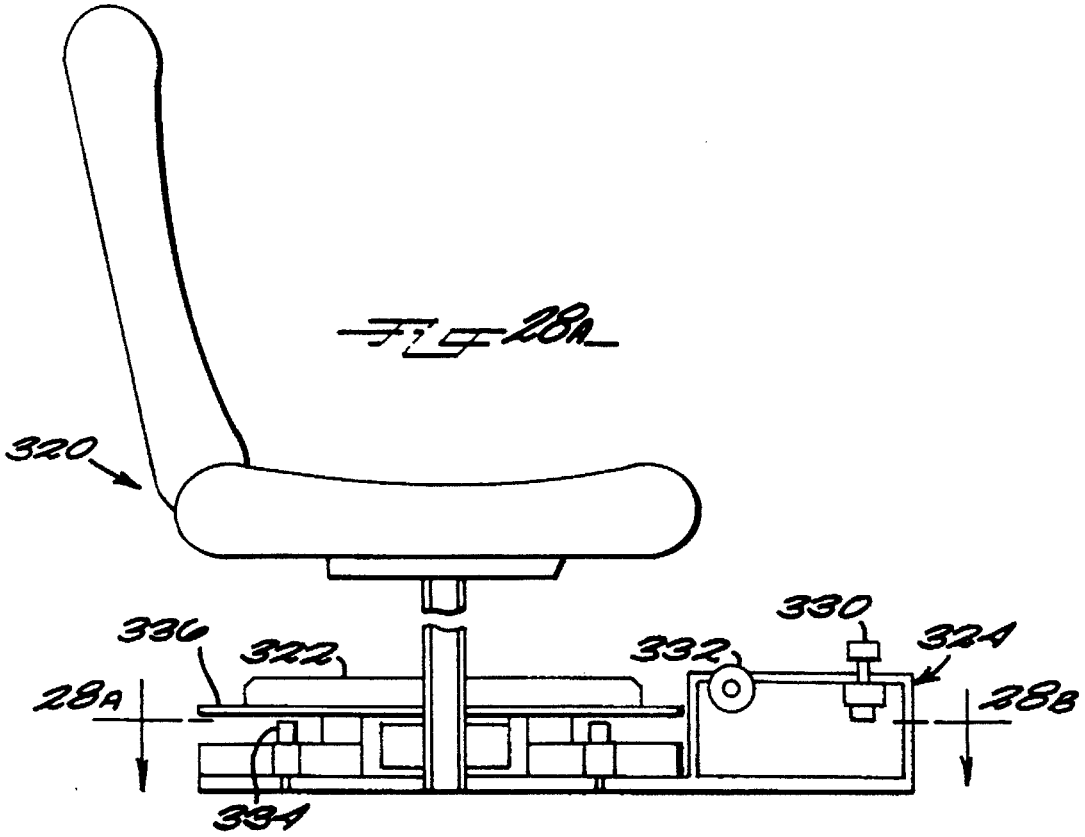
FIGS. 28*a* and 28*b* illustrate a side view and a top view (taken along lines 28*b*–28*b* of FIG. 28*a*), respectively, of still another preferred embodiment of the present invention having a chair mounted to a bearing assembly with foot controls.
Figure 28B:
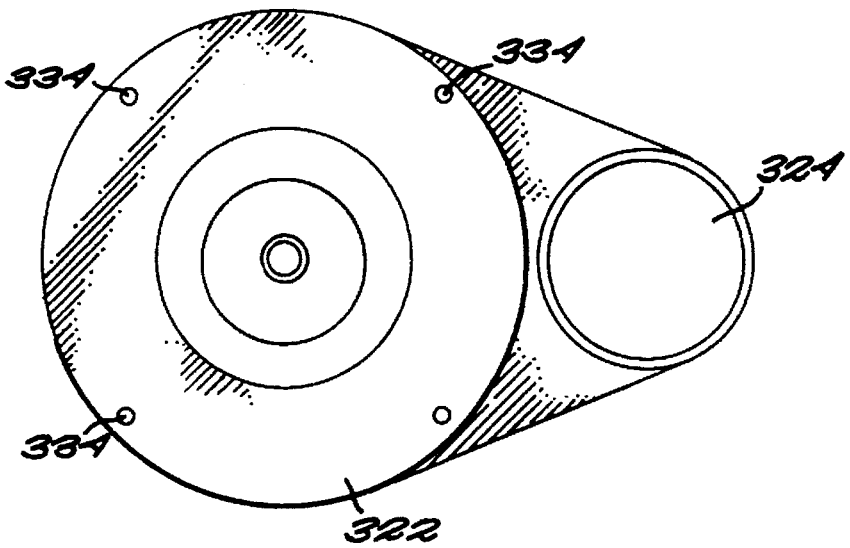

FIGS. 28*a* and 28*b* illustrate still another preferred embodiment according to the present invention. FIG. 28*a* shows a side view of a chair 320 in a bearing assembly 322 that carries a foot control 324. FIG. 28*b* is a top view taken along lines 28*b*—28*b* of FIG. 28*a*. Foot control 324 includes a forward/reverse switch 330, a speed control switch 332, and a series of on/off switches 334 (four shown) deployed about bearing assembly 322 under a flexible, resilient activation disk 336. (This on/off switch can alternatively be constructed as shown in FIG. 19.)

Chair 320 swivels freely in stationary bearing assembly 322. However, rotation of chair 320 does not affect the position of control 324, activation disk 336 and switches 334, which remain stationary. However, control 324 can be easily operated by foot (or hand) while sitting in chair 320 or standing near chair 320, regardless of the direction chair 320 is facing.

It will be apparent from the foregoing, specific descriptions of preferred embodiments that many changes and modifications can be made without departing from the spirit and scope of the present invention, which is defined by the appended claims.

What is claimed is:

1. An apparatus for maneuvering a boat on water, said apparatus comprising:

a trolling motor having a first shaft with a first axis, said trolling motor rotating about said first axis, and a first pulley coupled to said first shaft, said first pulley rotating with said first shaft about said first axis in a clockwise direction and a counterclockwise direction, said trolling motor rotating with said first shaft;

a bearing assembly having a second shaft with a second axis, said bearing, assembly being formed to receive a chair;

a second pulley mounted to said second shaft, said second pulley rotating about said second shaft;

a first cable connecting said second pulley to said first pulley, said first cable rotating said first pulley when said second pulley is rotated in said clockwise direction;

a second cable connecting said second pulley to said first pulley, said second cable rotating said first pulley when said second pulley is rotated in said counterclockwise direction; and means for activating said trolling motor, said activating means carried by said bearing assembly.

2. The apparatus as recited in claim 1, wherein said apparatus further comprises a speed control switch carried by and being rotatable with said bearing assembly, and wherein said activating means further comprises a switch rotatable with said second pulley, said switch activating said trolling motor when pressed.

3. The apparatus as recited in claim 1, wherein said apparatus further comprises a chair carried by said bearing assembly, wherein said activating means is carried by said chair.

4. The apparatus as recited in claim 1, wherein said bearing assembly further comprises a chair carried by said second shaft and wherein said activating means is a switch carried by said should shaft, said switch activating said trolling motor when said chair is tilted.

5. The apparatus as recited in claim 1, wherein said bearing assembly further comprises a chair and wherein said activating means is a switch carried by said chair so that, when a user is seated in said chair, said user activates said trolling motor by pressing on said switch using a leg.

6. The apparatus as recited in claim 1, wherein said bearing assembly further comprises a chair and wherein said activating means is a switch carried by said bearing assembly so that, when said user is seated in said chair, said user activates said trolling motor by pressing on said switch using a foot.

7. The apparatus as recited in claim 1, wherein said trolling motor further comprises means for coupling said first pulley to said first shaft, said coupling means having a coupled position and a decoupled position so that, when said coupling means is in said decoupled position, said first shaft can rotate independently of said first pulley.

8. An apparatus for maneuvering a boat on water, said apparatus comprising:

a trolling motor having an extended position wherein said trolling motor is positioned to extend into said water, and a retracted position wherein said trolling motor has been pulled out of said water, said trolling motor having a first shaft with a first axis, said trolling motor rotating about said first axis, a first pulley rotatable in a clockwise direction and a counterclockwise direction, and means for coupling said first pulley to said first shaft, said first pulley rotating with said first shaft about said first axis when said coupling means couples said shaft to said pulley, said trolling motor rotating with said first shaft;

a bearing assembly carried by said boat and rotatable with respect to said boat, said bearing assembly having a second shaft with a second axis, said bearing assembly formed to receive a chair;

a second pulley carried by said second shaft, said second pulley rotating with said bearing assembly about said second axis;

a first cable connecting said second pulley to said first pulley, said first cable rotating said first pulley when said bearing assembly is rotated in said clockwise direction;

a second cable connecting said second pulley to said first pulley, said second cable rotating said first pulley when said bearing assembly is rotated in said counterclockwise direction; and means carried by said boat and located proximate to said bearing assembly for activating said trolling motor.

9. The apparatus as recited in claim 8, wherein said activating means is a switch operated by a foot of a user.

10. The apparatus as recited in claim 8, further comprising a base for a seat, said base carried by said boat and located proximate to said bearing assembly so that a user, sitting in said seat and said seat being positioned in said base, can rotate said bearing assembly and activate said activating means.

11. The apparatus as recited in claim 8, wherein said activating means further comprises an activation switch carried by said bearing assembly, said activation switch operated by a foot of a user.

12. The apparatus as recited in claim 8, wherein said bearing assembly has a plurality of slots formed therein and said chair has means formed thereon for engaging any one slot of said plurality of slots.

13. The apparatus as recited in claim 8, wherein said coupling means further comprises:

a direction plate attached to said first shaft and having a plurality of slots;

key means for engaging any one slot of said plurality of slots, said key means carried by said first pulley and rotating said direction plate and said first shaft when said first pulley is rotated by said first and said second cables.

14. The apparatus as recited in claim 8, wherein said trolling motor further comprises means for indicating orientation of said trolling motor so that said user can determine orientation of said trolling motor from said indicating means when said trolling motor is in said water.

15. An apparatus for maneuvering a boat on water, said apparatus comprising:

a trolling motor having a first shaft with a first axis, said trolling motor rotating about said first axis, and a first pulley coupled to said first shaft and having a first diameter, said first pulley rotating with said first shaft about said first axis in a clockwise direction and a counterclockwise direction, said trolling motor rotating with said first shaft;

a bearing assembly having a second shaft with a second axis and formed for receiving a chair;

a second pulley mounted to said bearing assembly, said second pulley having a second diameter at least approximately twice the size of said first diameter, said second pulley rotating about said second axis;

a first cable connecting said second pulley to said first pulley, said first cable rotating said first pulley when said second pulley is rotated in said clockwise direction; and a second cable connecting said second pulley to said first pulley, said second cable rotating said first pulley when said second pulley is rotated in said counterclockwise direction.

16. The apparatus as recited in claim 15, further comprising means carried by said bearing assembly and rotatable therewith for activating said trolling motor.

17. The apparatus as recited in claim 15, further comprising:

a chair carried by said bearing assembly and rotatable therewith;

means for activating said trolling motor carried by said chair a steed control switch carried by said chair, and a polarity switch carried by said chair.

18. The apparatus as recited in claim 15, further comprising means carried by said boat for activating said trolling motor spaced proximate to said bearing assembly and rotatable therewith a speed control switch carried by said boat, said speed control switch spaced proximate to said bearing assembly and rotatable therewith, a polarity switch carried by said boat, said polarity switch spaced proximate to said bearing assembly and rotatable therewith.

19. The apparatus as recited in claim 15, further comprising:

a chair carried by said bearing assembly and rotatable therewith; and a control panel carried by said chair, said control panel having a first switch for activating said trolling motor, a second switch for controlling speed of said trolling motor, and a third switch for controlling direction of said trolling motor.

20. The apparatus as recited in claim 15, further comprising a control panel carried by said bearing assembly, said control panel having a first switch for activating said trolling motor;

a second switch for controlling speed of said trolling motor; and a third switch for controlling direction of said trolling motor.

* * * * *